US010403129B1

(12) United States Patent
Suarez

(10) Patent No.: US 10,403,129 B1
(45) Date of Patent: Sep. 3, 2019

(54) TACTILE WARNING PAD FOR A PEDESTRIAN NOTIFICATION SYSTEM

(71) Applicant: Jaime Suarez, Omaha, NE (US)

(72) Inventor: Jaime Suarez, Omaha, NE (US)

( * ) Notice: Subject to any disclaimer, the term of this patent is extended or adjusted under 35 U.S.C. 154(b) by 0 days.

(21) Appl. No.: 16/003,673

(22) Filed: Jun. 8, 2018

Related U.S. Application Data

(60) Provisional application No. 62/516,779, filed on Jun. 8, 2017.

(51) Int. Cl.
*G08G 1/005* (2006.01)
*G08B 6/00* (2006.01)

(52) U.S. Cl.
CPC ..... *G08G 1/005* (2013.01); *G08B 6/00* (2013.01)

(58) Field of Classification Search
CPC .... A61H 2201/5097; E01F 9/559; G08B 6/00
USPC ..... 340/944
See application file for complete search history.

(56) References Cited

U.S. PATENT DOCUMENTS

2008/0095576 A1* 4/2008 Donald ..... A61H 3/066 404/34
2009/0256723 A1* 10/2009 Peddie ..... G08G 1/096783 340/907
2010/0308982 A1* 12/2010 Cooperstock ..... G06F 3/011 340/407.1
2011/0291804 A1* 12/2011 Chan ..... A61H 3/066 340/10.1
2012/0223843 A1* 9/2012 Wall ..... G08G 1/095 340/944
2012/0234247 A1* 9/2012 Graves ..... A01K 1/0158 119/28.5
2017/0252256 A1* 9/2017 Henshue ..... A61H 3/061

* cited by examiner

*Primary Examiner* — Fabricio R Murillo Garcia
(74) *Attorney, Agent, or Firm* — Suiter Swantz pc llo

(57) ABSTRACT

A tactile warning pad is configured for working in conjunction with a pedestrian notification system. The tactile warning pad includes a base pad, a pad and communication control unit, and a warning output device. The base pad has a plurality of tactile structures on a surface of the base pad. The base pad at least partially houses or is coupled to the pad and communication control unit and the warning output device. The warning output device is communicatively coupled with the pad communication and control unit and is configured to receive a warning control signal from the pedestrian notification system via the pad communication and control unit and to generate an output warning based on the warning control signal.

17 Claims, 9 Drawing Sheets

TACTILE WARNING PAD FOR A PEDESTRIAN NOTIFICATION SYSTEM

CROSS-REFERENCE TO RELATED APPLICATIONS

The present application claims the benefit under 35 U.S.C. § 119(*e*) of U.S. Provisional Application Ser. No. 62/516,779, filed Jun. 8, 2017, and titled "TACTILE WARNING PAD FOR A PEDESTRIAN NOTIFICATION SYSTEM," which is incorporated herein by reference in its entirety.

TECHNICAL FIELD

The present application relates generally to tactile warning pads, and, more particularly, a tactile warning pad for a pedestrian notification system.

BACKGROUND

A pedestrian crossing or crosswalk is a place designated for pedestrian to cross a road. Crosswalks are designed to keep pedestrians together where they can be seen by motorists and/or cyclists, and where they can cross most safely across the flow of vehicular traffic. Tactile paving (also called truncated domes, detectable warnings, tactile ground surface indicators, or detectable warning surfaces) is a system of textured ground surface indicators found on footpaths, stairs and train station platforms to assist pedestrians that are visually impaired. Such tactile paving has been instituted as a standard by several countries.

SUMMARY

Aspects of the disclosure relate to a tactile warning pad. The tactile warning pad is configured for working in conjunction with a pedestrian notification system. The tactile warning pad includes a base pad, a pad and communication control unit, and a warning output device. The base pad has a plurality of tactile structures on a surface of the base pad. The base pad at least partially houses or is coupled to the pad and communication control unit and the warning output device. The warning output device is communicatively coupled with the pad communication and control unit and is configured to receive a warning control signal from the pedestrian notification system via the pad communication and control unit and to generate an output warning based on the warning control signal.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Figure 1:
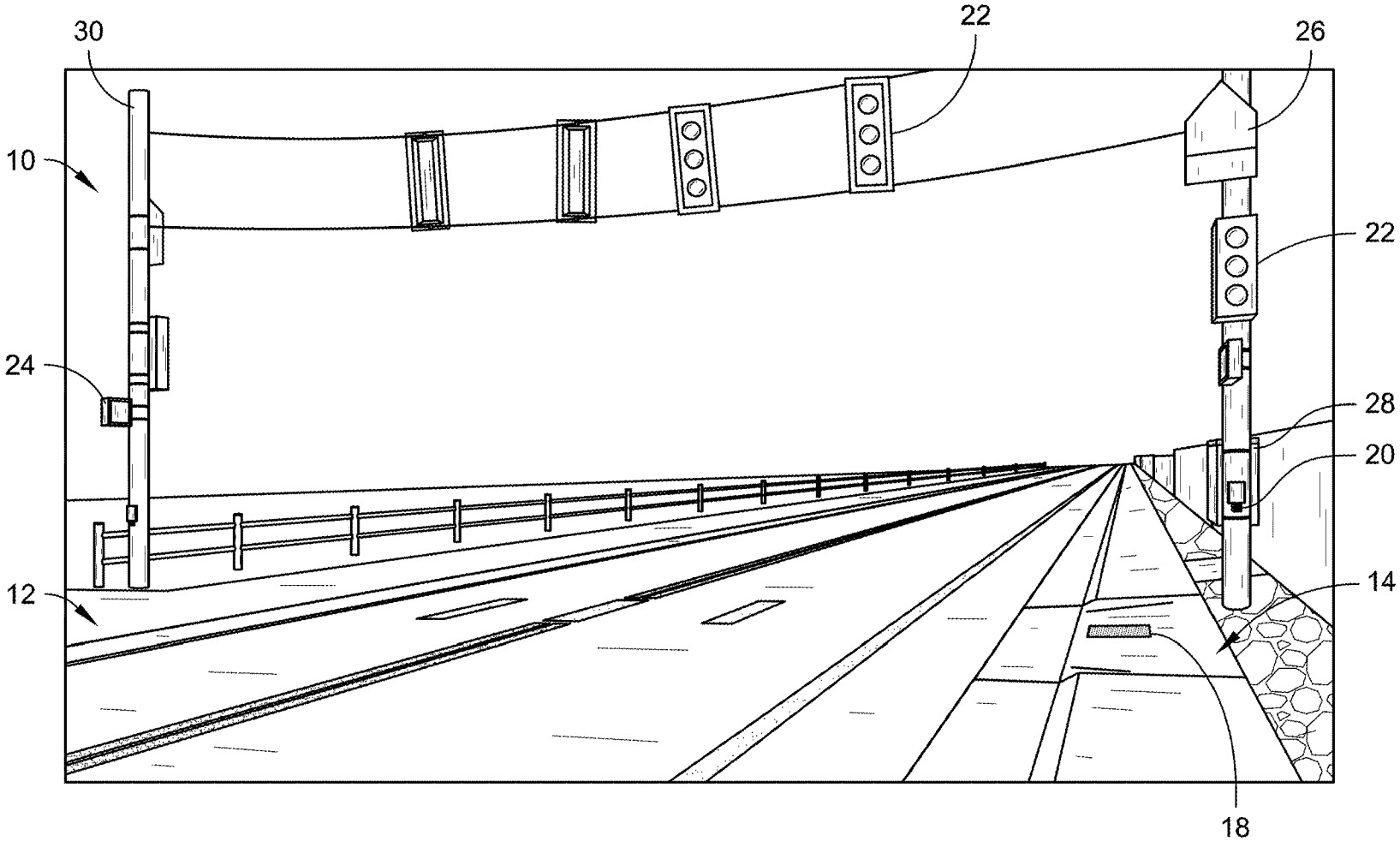
FIG. 1 is a perspective view of a crosswalk system used in a relation to a street, in accordance with example embodiments of the present disclosure.

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense. In one aspect, features of the disclosure are executed in a computer and/or controller system described herein.

Tactile paving has been implemented in several countries, initially as an aid to visually impaired pedestrians. However, the present disclosure relates to tactile warning pads that can be used to alert not only the visually impaired but children and/or potentially distracted pedestrians. Often, potentially distracted pedestrians are distracted because they are on their smart phones or other wireless devices. The tactile warning pads of the present crosswalk system can help counteract the distractions by directly signaling (e.g., via embedded lights; haptic/vibratory feedback; etc.) to a pedestrian whether it is okay to cross a street and/or by automatically activating any pedestrian and/or traffic signals associated with the crosswalk.

As shown in FIGS. 1-6, a crosswalk system 10 in accordance with an embodiment of the present disclosure is arranged and configured to promote safe crossing of a road 12 (e.g., street, boulevard, highway, etc.), typically relative to one or more sidewalks 14. The crosswalk system 10 may include one or more of each of a marked crosswalk 16, a tactile warning pad 18, an activation button 20 (e.g., signal call button), a traffic signal 22, a crosswalk signal 24 (e.g., a pedestrian signal), a crosswalk sign 26 (e.g., a school crosswalk sign (as shown) or a more generic crosswalk sign), and a crossing control unit 28. Per the illustrated embodiment, the marked crosswalk 16 is on the road 12; the tactile warning pad 18 is carried (e.g., mounted on, embedded in, co-molded with, etc.) by a corresponding sidewalk 14; and the activation button(s) 20, the traffic signal(s) 22, the crosswalk signal(s) 24, crosswalk sign(s) 26, and the crossing control unit 28 are carried by one or more traffic poles 30 or another upright support structure, such as a post, to which one or more such elements can be directly or indirectly attached, with such poles or posts generally being located outside the flow of traffic (e.g., on or proximate the sidewalk or on a traffic island in the middle of the road). In some embodiments, the marked crosswalk 16, the activation button 20, the traffic signal 22, the crosswalk signal 24, and the crosswalk sign 26, along with the tactile nature of the tactile warning pad 18, may be in accordance with industry standards set forth in, for example, the Manual on Uniform Traffic Control Devices (MUTCD) and/or the Americans with Disabilities Act (ADA), as used in the United States, and any such elements that meet known industry standards, except where otherwise expressly discussed herein, are deemed to be with the scope of the present disclosure.

Marked crossings 16 may include some markings (e.g., spaced, wide white bands (as shown); a parallel set of white lines at sides of crosswalk; etc.) on the road 12 to denote the crosswalk region. In the UK these are often called Zebra crossings, referring to the alternate white and black stripes painted on the road surface. Any accepted pavement markings or indicators (e.g., a raised pavement zone, embedded lights) used to identify a crosswalk region are deemed to be within the scope of the present disclosure.

Figure 2:
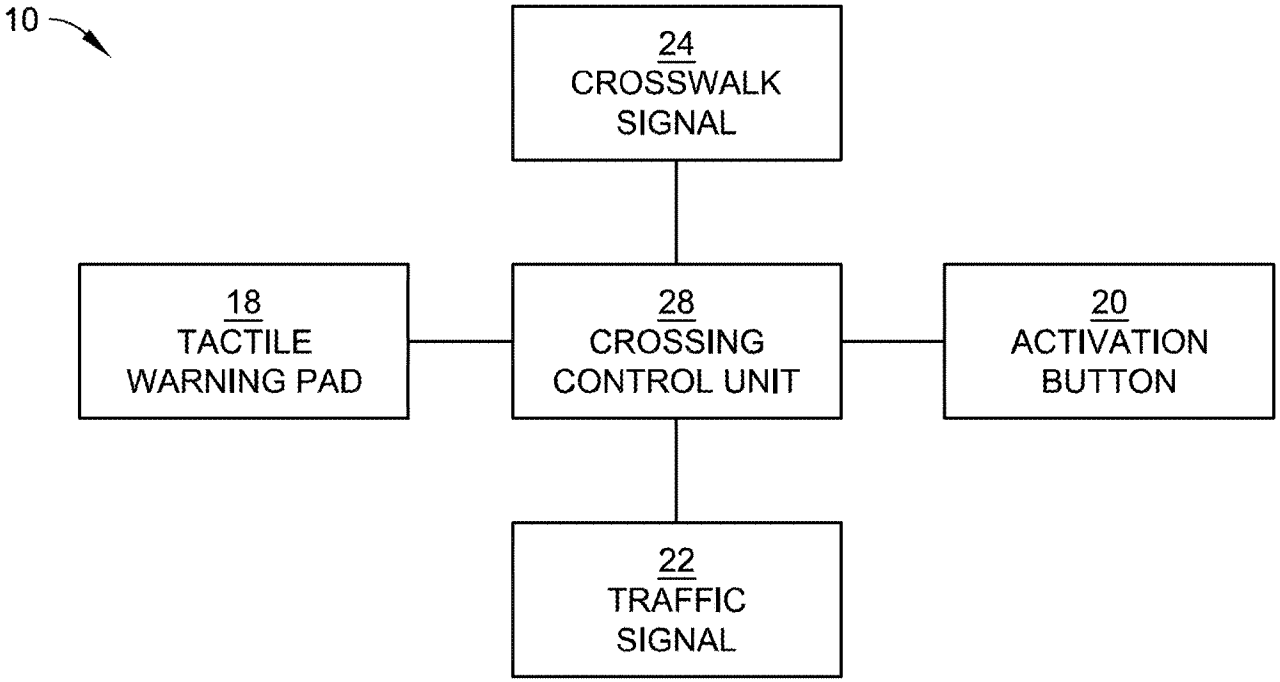
FIG. 2 is a block diagram illustrating components of the crosswalk system shown in FIG. 1, in accordance with example embodiments of the present disclosure.
Figure 3:
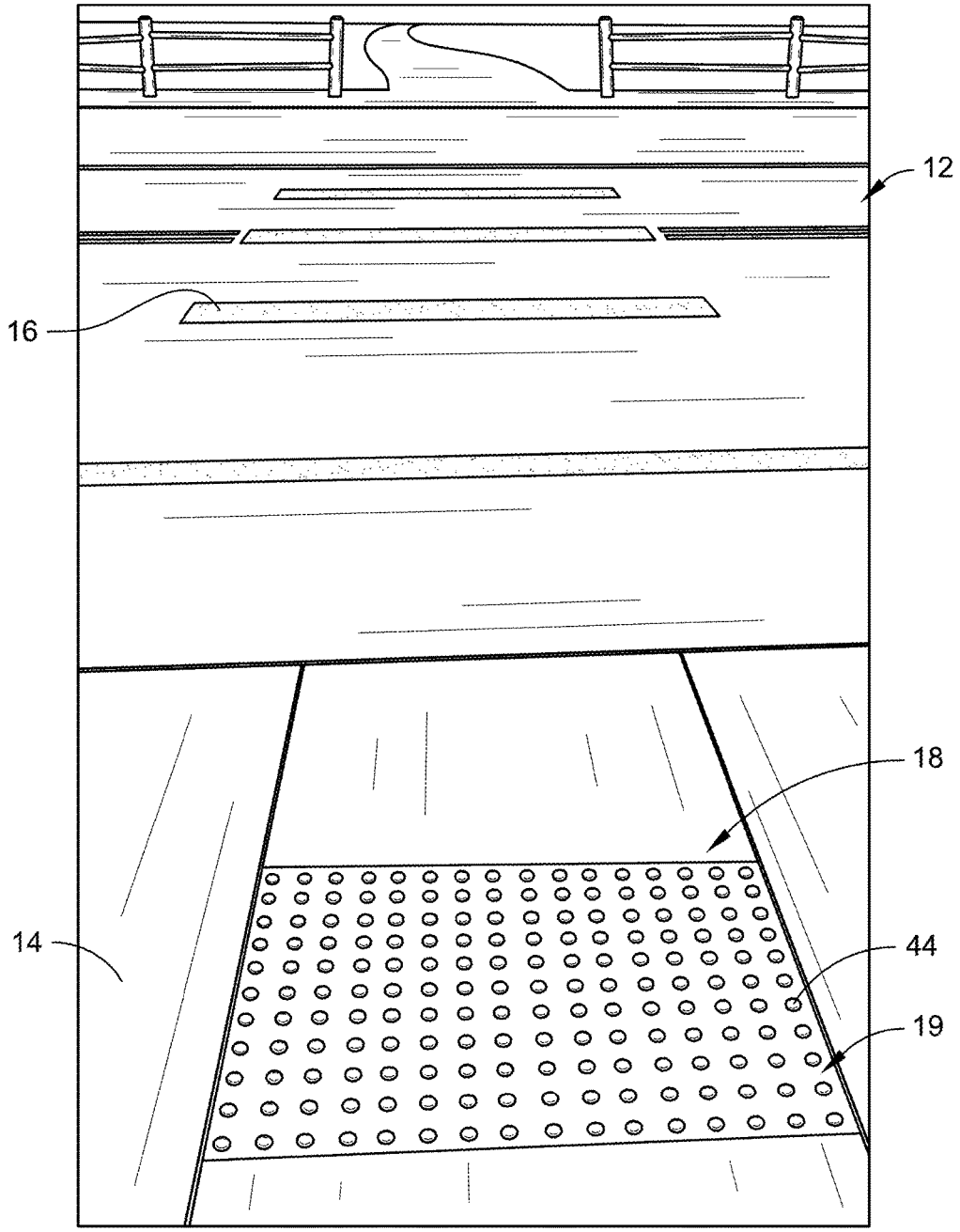
FIG. 3 is a perspective view of a tactile warning pad and the related crosswalk shown in FIG. 1, in accordance with example embodiments of the present disclosure.
Figure 4:
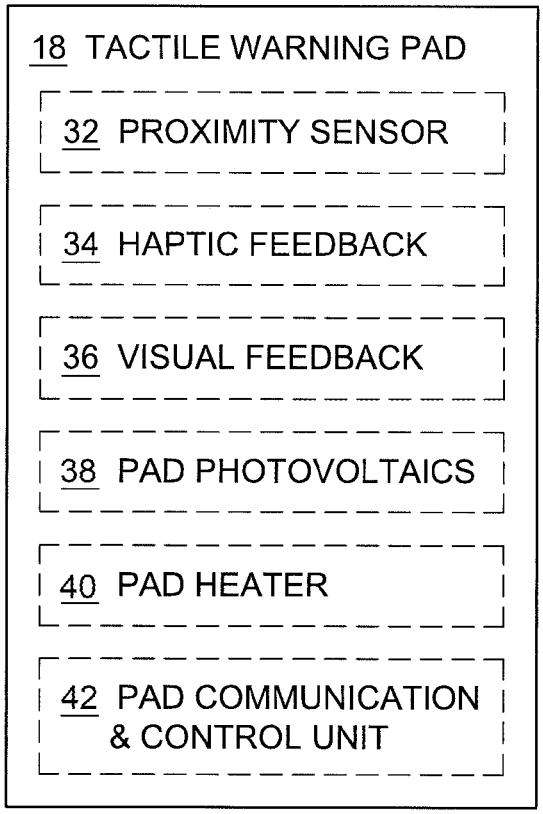
FIG. 4 is a block diagram illustrating components of the tactile warning pad of the crosswalk system shown in FIG. 1, in accordance with example embodiments of the present disclosure.
Figure 5:
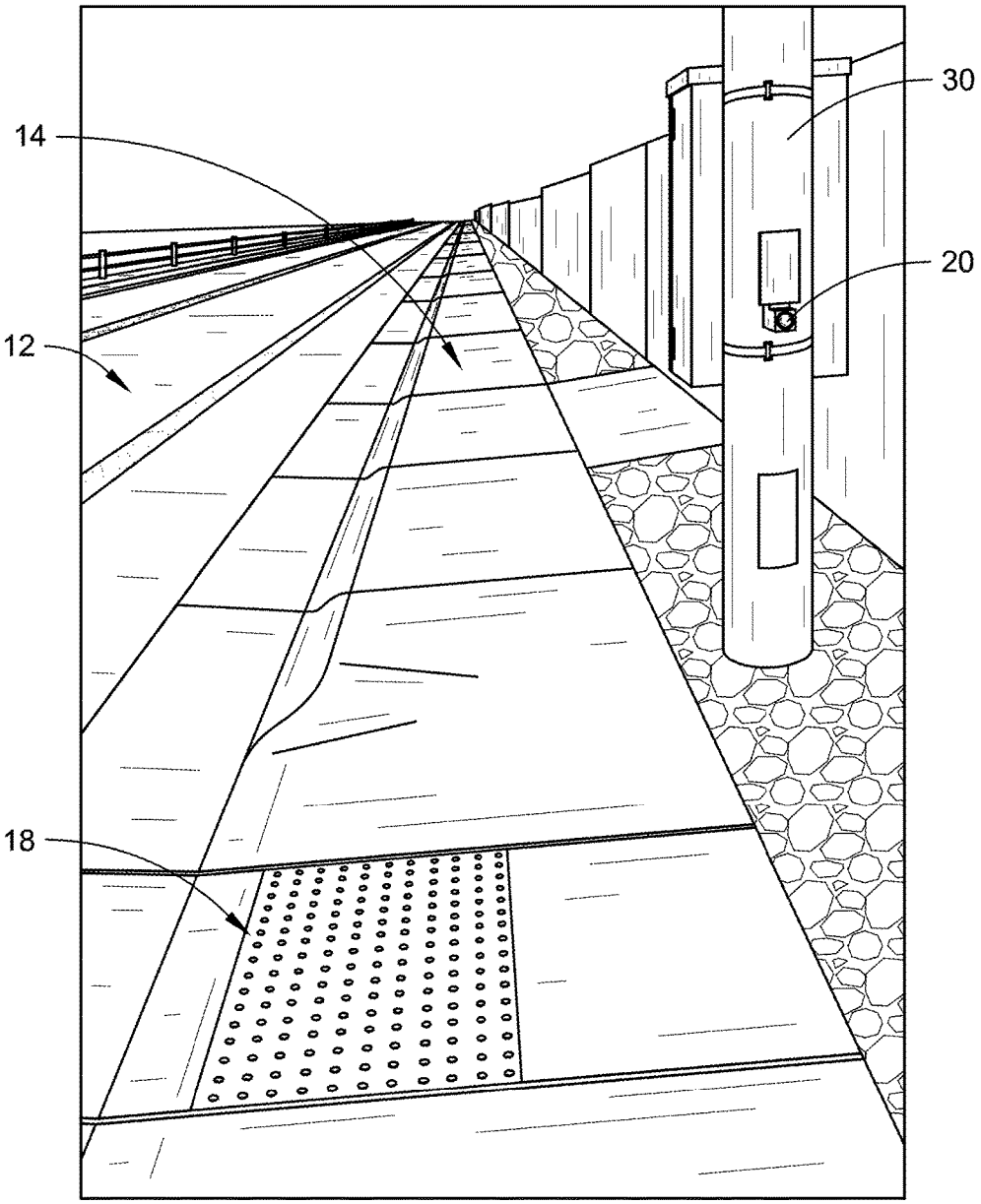
FIG. 5 is a zoomed in perspective view of the tactile warning pad, a traffic pole, a crossing activation button and the crossing control unit mounted on the traffic pole, and a sidewalk portion, in accordance with example embodiments of the present disclosure.

In some embodiments, such as schematically illustrated in FIG. 2, the tactile warning pad 18, the activation button(s) 20, the traffic signal(s) 22, and/or the crosswalk signal(s) 24, may be communicatively and/or electrically coupled to the crossing control unit 28 and may further be linked with a power source, such as a power grid, battery source, or photovoltaics. The components 18, 20, 22, 24 may communicate with the crossing control unit 28 via a wired and/or wireless connection, and the crossing control unit 28 coordinates the function of such components. The activation button 20 (e.g., call button), if employed, can be configured to trigger, through communication with the crossing control unit 28, the operation of the traffic signal(s) 22 and the crosswalk signal(s) 24, upon, for example, pressing, touching, or otherwise activating the activation button 20 by a pedestrian. The activation button 20 can employ, by way of example, a pressure sensor, an optical sensor, and a touch (e.g., capacitance or electrostatic) sensor, along with a signal relay. The activation button(s) 20 are mounted on a traffic pole 30 or another upright support at height so as be activation range of most people (including children and/or people in wheelchairs). The activation button(s) 20 may include additional tactile and/or haptic (e.g., vibratory) indicators to aid the visually impaired. In some embodiments, the cycling of the traffic signal(s) 22 and the crosswalk signal(s) 24, at least under some circumstances, may be controlled directly by the crossing control unit 28, based on a desired timing of traffic flow.

The signaling mechanisms (the traffic signal(s) 22 and/or the crosswalk signal(s) 24) may be in accordance with MUTCD or other local standards and can communicate with and be controlled by the crossing control unit 28. A traffic signal 22 may be in the form of a stop light (as shown in FIG. 1) and/or another lit signal (e.g., such as those to be described later in relation to FIG. 8). The lit signal may, in some embodiments, involve flashing lights (e.g., LED (light-emitting diodes)) on a sign perimeter and/or embedded in a road pavement.

Figure 6:
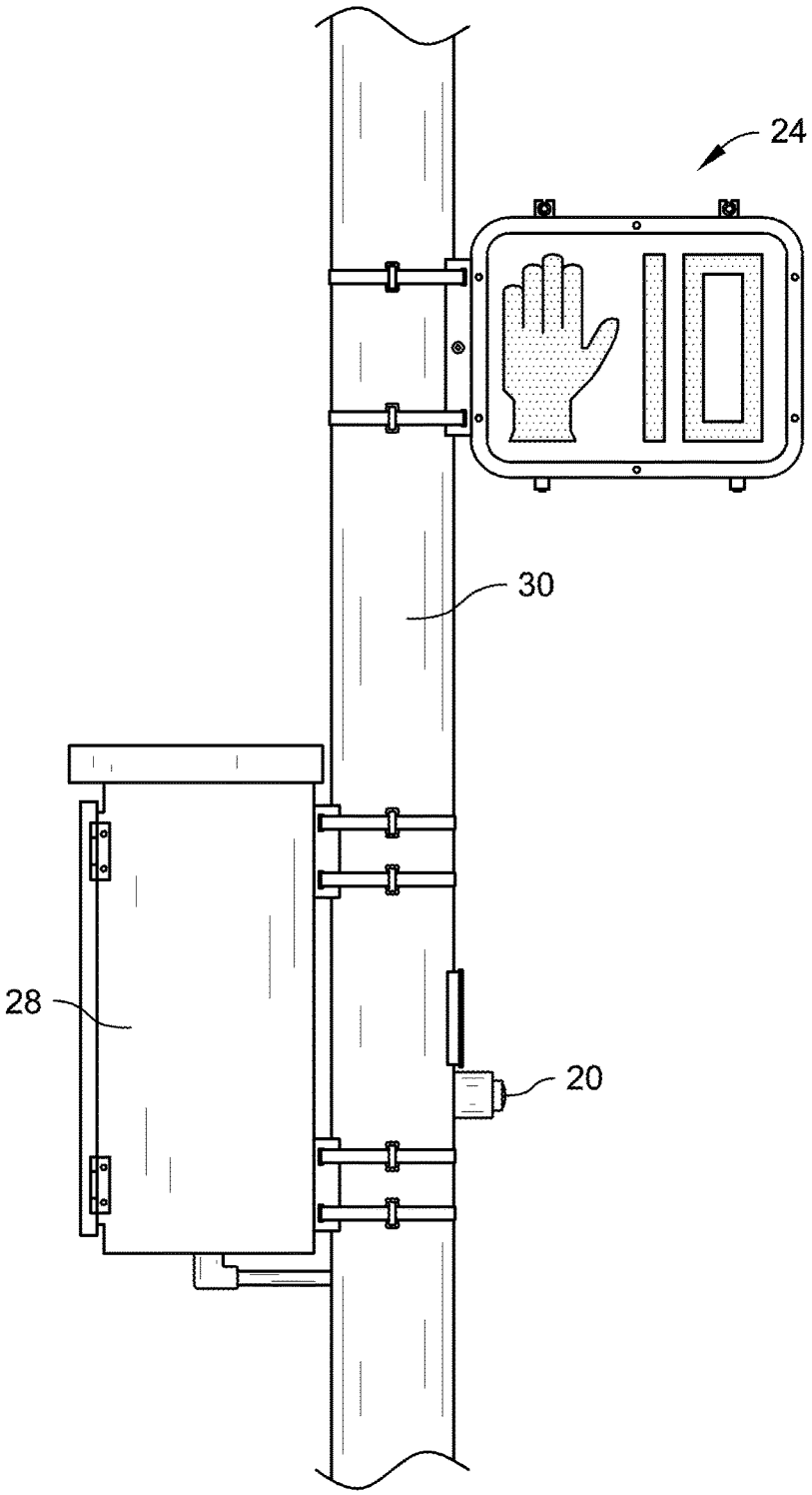
FIG. 6 is a zoomed in side view of the traffic pole, along with a crossing signal, the crossing activation button and the crossing control unit mounted on the traffic pole, in accordance with example embodiments of the present disclosure.

A crosswalk or pedestrian signal 24 can include a visual component and may further include an audio component. Per 2009 MUTCD, the three visible phases of one embodiment of a crosswalk signal 24 can be a steady upraised hand (with the upraised hand being shown in FIG. 6) indicating "don't walk"; a flashing upraised hand indicating that a "don't walk" period is imminent, and a steady walking man indicating "walk". Per 2009 MUTCD, a crosswalk signal 24 may further include a related countdown timer (as shown in FIG. 6) associated with the flashing upraised hand, relaying the time until a "don't walk" status is to be reached and/or a change in the traffic signal(s) 22 is to occur. In some embodiments, the terms "walk" and "don't walk", in an appropriate local language, can be used instead of the walking man and the upright hand. In yet some further embodiments, a crosswalk signal 24 may provide an audio component (e.g., beeping, chirping, ticking, speech message, etc.) to further aid in alerting pedestrians of the crosswalk status who may not otherwise be able to clearly see (e.g., visually impaired or blocked from view thereof) the visual component of the crosswalk signal 24 and/or who may otherwise be distracted.

One or more crosswalk signs 26 may be employed at or in advance of the marked crossing 16. The crosswalk signs 26 may, for example, be in the form of a house-shaped school crosswalk sign (as per FIG. 1), if proximate to a school, or a more generic, diamond-shaped crosswalk sign (as per FIG. 8). Such signs, in some embodiments, may be in accordance with industry standards, such as those set forth in MUTCD.

The tactile warning pad 18, in the context of the crosswalk system 10, is generally positioned on an edge portion of a sidewalk 14 leading into a marked crossing or crosswalk 16. The portion of the sidewalk 14 carrying the tactile warning pad 18 and area immediately surround the tactile warning pad 18 further may be sloped downwardly toward the marked crossing 16 in order, for example, to accommodate those in wheel chairs and/or to reduce the chances of tripping while heading into the marked crossing 16. The base tactile warning pad 19 can, in some embodiments, be yellow, red, or any color that provides a good contrast to the surrounding area (e.g., a sidewalk 14). The tactile warning pad 18 may include one or more of, for example, a proximity sensor 32, a haptic feedback element 34 (e.g., vibrating element or other force based signaling device), a visual feedback element 36 (e.g., LED or other visual signaling device), an audible feedback element (e.g., speaker or other audio signaling device), a pad-based photovoltaic array 38 (e.g. pad photovoltaics), a pad heater 40 (e.g., an electrically powered heating element), and/or a pad communication and control unit 42. The pad communication and control unit 42, if present, may be configured to facilitate communication between the tactile warning pad 18 and the crossing control unit 28 and may further be configured to locally control the operation of the proximity sensor 32, the haptic feedback element 34, the visual feedback element 36, the pad-based photovoltaics 38, and/or the pad heater 40, where such communications may be accomplished by some combination of wired or wireless connections. In one broader sense, the haptic feedback element 34 and the visual feedback element 34 can be examples of warning output devices configured to be controlled, e.g., via the pad communication and control unit 42. In other embodiments, the functionality of the pad communication and control unit 42 may be incorporated all or in part into the crossing control unit 28. For example, in some embodiments, the pad communication and control unit 42 may primarily serve to provide a communication link between the components of the tactile warning pad 18 and the crossing control unit 28. It is to be understood that the crossing control unit 28 of the present crosswalk system 10 may have additional hardware and/or software, as needed, that expressly permits it to communicate with and otherwise operate in conjunction with the tactile warning pad 18 (e.g., receive input signals therefrom and/or send command signals thereto).

In embodiments, a warning output device (e.g., the haptic feedback element 34, the visual feedback element 36, audible feedback element, etc.) is communicatively coupled with the pad communication and control unit 42 and is configured to receive a warning control signal from a pedestrian notification system (e.g., crossing control unit 28) via the pad communication and control unit 42. The warning output device is further configured to generate an output warning (e.g., haptic feedback (e.g., vibrations), visual feedback (e.g., light), audible feedback (e.g., sound), etc.) based on the warning control signal.

Figure 9:
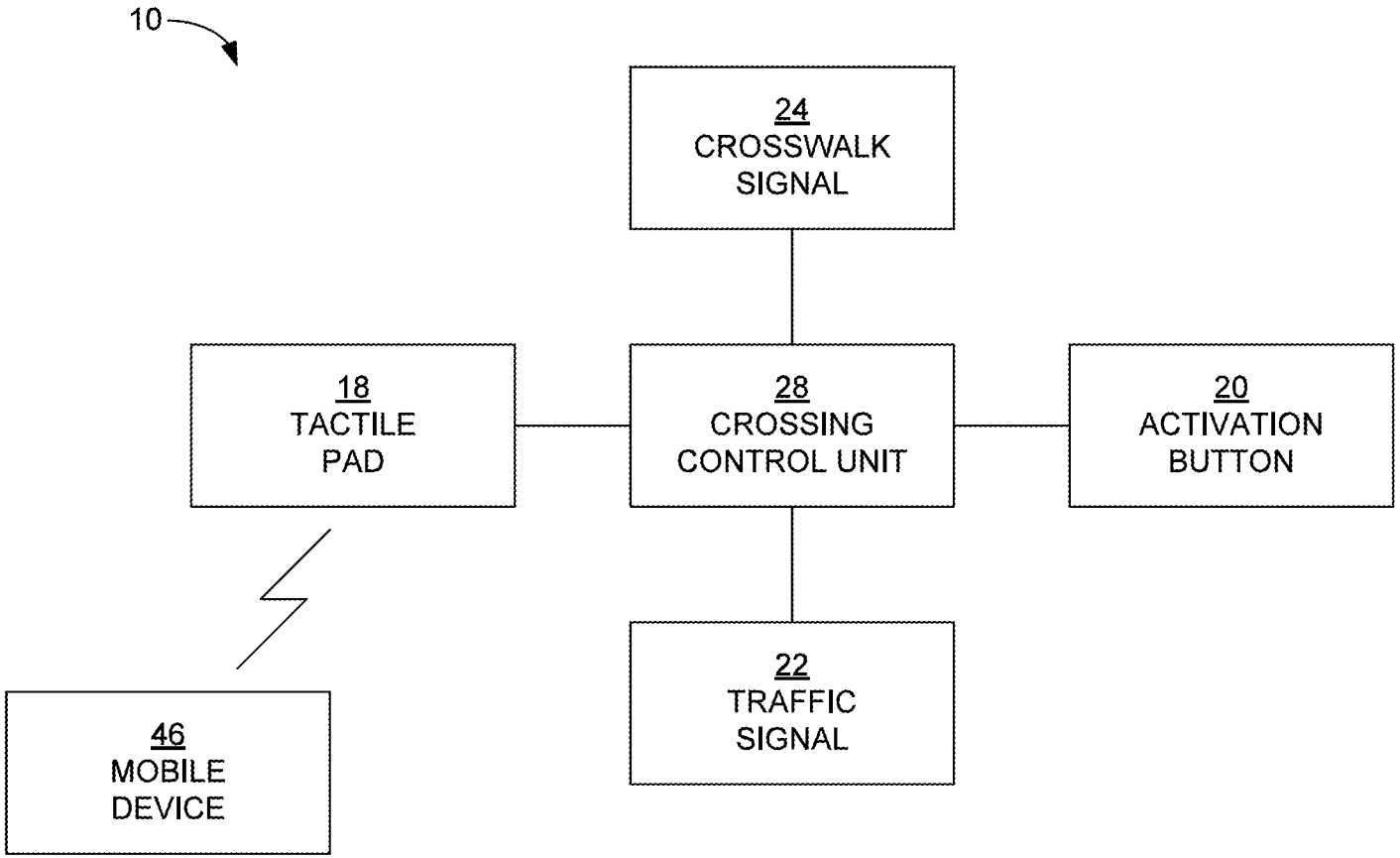
FIG. 9 is another block diagram illustrating components of the crosswalk system shown in FIG. 1, in accordance with example embodiments of the present disclosure.

In an embodiment shown in FIG. 9, the tactile warning pad 18 and/or crossing control unit 28 is communicatively coupled with a pedestrian's mobile device 46. For example, the tactile warning pad 18 may include a wireless transmitter (e.g., Bluetooth transmitter/transceiver, Wi-Fi transmitter/transceiver, near-field communication (NFC) transmitter/transceiver, or the like). The tactile warning pad 18 and/or crossing control unit 28 may be configured to generate an output warning by broadcasting an alert to one or more mobile devices 46 that are less than a threshold distance from the tactile warning pad 18. For example, the pad communication and control unit 42 may be configured to transmit a warning control signal to the mobile device 46 that causes the mobile device 46 to generate a mobile device output (e.g., "walk" or "don't walk" notification, green/red light, audible feedback (e.g., sound), haptic feedback (e.g., vibrations), or the like). In this regard, the mobile device 46 behaves as an output warning device. This can be particularly useful in mitigating pedestrian endangerment that results from pedestrians being distracted by their own mobile devices.

In addition to the electrical and/or communication functions associated with the tactile warning pad 18, the tactile warning pad 18 may include one or more tactile structures 44. Such tactile structures 44 may be in the form of truncated domes, cones, bars, or pronounced grooves. These tactile structures 44 can be detectable by a long cane or underfoot, thereby assisting pedestrians who may be visually impaired. Also, such tactile structures 44 may further offer added traction, possibly reducing the chances of slipping upon walking into a marked crossing 16. In addition to being used adjacent to marked crossings 16, a tactile warning pad 18, with its electrical functionality and tactile structures 44, may prove beneficial at train station platforms, triggering alerts, for example, to oncoming trains, opening train doors, and/or closing train doors and providing a mechanism by which to display/output those alerts. Accordingly, in the broader sense, the tactile warning pad 18 can be used as part of any pedestrian notification system (e.g., at a crosswalk or at a train platform) and particularly in situations where moving vehicles (e.g., cars, trucks, buses, trains) may need to be accounted for.

The base structure 19 of the tactile warning pad 18, including the tactile structures 44 but excluding the electrical components, may be formed by any suitable method and of any suitable materials. For example, the tactile warning pad 18 may be molded, machined, or otherwise formed from a suitably durable and weather-resistant material, such as a metal or heavy duty plastic or polymer. Further, the tactile warning pad 18 can be formed from multiple formed portions that can otherwise encase most, if not all, the electrical portions associated therewith, once those multiple formed portions are bound (e.g., adhesive, plastic or metal welding, etc.) together in a suitably weather-tight manner. In some embodiments, the electrical component can be linked together through a wiring harness, one or more printed circuit boards, and/or other electrical connections and then the base tactile warning pad may be formed therearound, yielding a finished tactile warning pad 18 in accordance with an exemplary embodiment. It is to be understood, however, that any pad-based photovoltaic (PV) array 38 will need to mounted in such a manner to be exposed to enough sunlight or other ambient light (e.g., not covered; or covered with a clear glass or plastic that permits suitable sunlight to reach to the PV array 38). By being mounted in such a manner, the PV array 38 may sufficiently harness enough light for powering the tactile warning pad 18 and/or other electrical portions of the crosswalk system 10.

The proximity sensor(s) 32 can be configured to sense the presence of one or more pedestrians on or near the tactile warning pad 18 and to communicate that information with the pad communication and control unit 42 and/or the crossing control unit 28. For example, the proximity sensor (s) 32 may be at least partially housed within or coupled to the base tactile pad 19 and configured to detect pedestrians approaching or standing on the base tactile pad 19. The pad communication and control unit 42 may be communicatively coupled to proximity sensor(s) 32 and configured to generate one or more control signals for the crossing control unit 28 when the proximity sensor(s) 32 detect pedestrians approaching or standing on the base tactile pad. Based on the information ultimately communicated to the crossing control unit 28 from the proximity sensors, the traffic signal(s) 22 and/or the crosswalk signal(s) 24 can be activated in the same manner as if one or more of the activation buttons 20 had been pressed. Thus, even if a pedestrian fails to use the activation button 20, the present crosswalk system 10 can institute a crossing sequence via the proximity sensor(s) 32, working on an underlying premise that a pedestrian on the tactile warning pad 18 likely wants to cross the road 12. The proximity sensor(s) 32 may take one or more forms, such as, but not limited to, an optical sensor, a pressure or force sensor, a microwave sensor, a sound-based sensor, and/or an infrared sensor. The proximity sensor(s) 32, in some embodiments, may not only be able to detect a pedestrian who is on the tactile warning pad 18 but also one who is approaching it.

In some embodiments, the tactile warning pad 18 may include one or more haptic feedback elements 34. Haptic (e.g., kinesthetic) communication is associated with active touch to communicate or recognize objects and can involve applying forces, vibrations, or motions to an end user. In some embodiments, the haptic feedback element 34 can communicate to a pedestrian using vibrations. It is to be understood that, for example, differing vibrational intensities and/or rates could be used to signal to a pedestrian a crosswalk (e.g., walk, don't walk, etc.) or train platform (e.g., train approaching, okay to enter, etc.) status. The output of the haptic feedback element 34 can be controlled, e.g., by the pad communication and control unit 42 and/or the crossing control unit 28.

In some embodiments, the tactile warning pad 18 can include one or more visual feedback elements 36. The visual feedback elements 36, by way of example, may include lights, such as light-emitting diodes (LEDs) or other light sources, and/or apparent changes in color of some or all portions of the tactile warning pad 18. Where the visual feedback elements 36 are lights, the status (e.g., output) of the lights (e.g., flashing, not flashing, rate of flash, and/or color) may be selectively chosen (e.g., by the pad communication and control unit 42 and/or the crossing control unit 28) to signify a change in a crosswalk or train platform status. For example, red (e.g., stop) and green (e.g., okay to go or proceed) lights may be used, with flashing red signifying a need to prepare to stop (e.g., like a yellow signal in a traffic stop light). Such visual feedback elements 36 may be particularly helpful to alert pedestrians who are distracted and/or looking down at their smart phones or other mobile devices.

Figure 7A:
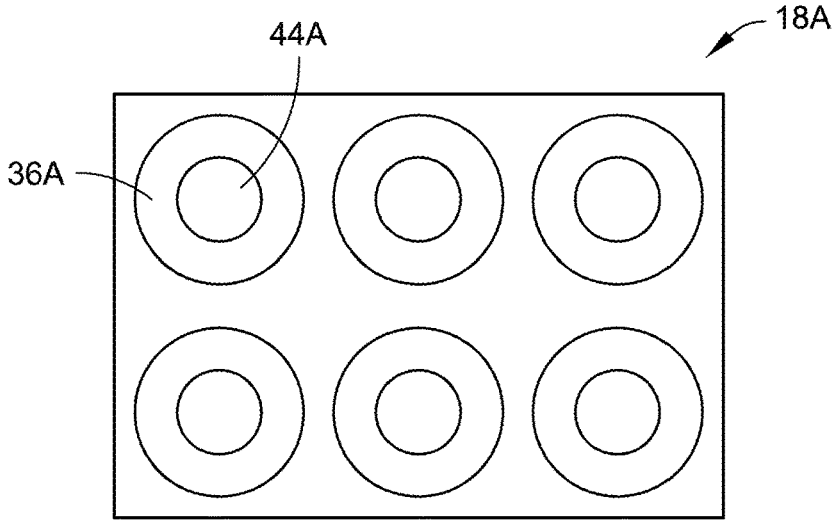
FIGS. 7A is a top view of a tactile warning pad with one or more visual feedback elements, in accordance with example embodiments of the present disclosure.
Figure 7B:
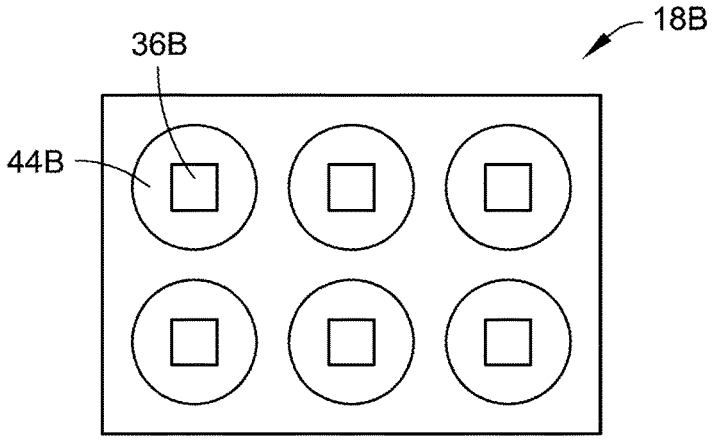
FIGS. 7B is a top view of a tactile warning pad with one or more visual feedback elements, in accordance with example embodiments of the present disclosure.
Figure 7C:
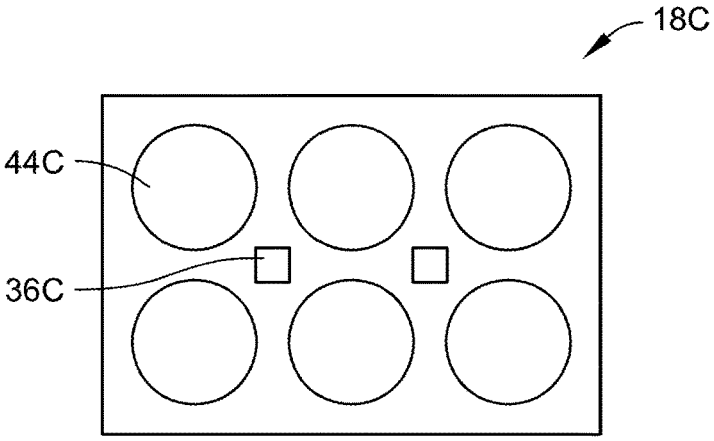
FIGS. 7C is a top view of a tactile warning pad with one or more visual feedback elements, in accordance with example embodiments of the present disclosure.

FIGS. 7A-7C illustrate three potential layouts for the visual feedback elements within a tactile warning pad. In FIGS. 7A-7C, like numbered parts as those associated with the tactile warning pad 18 are expected to have the same general features and/or functionality as discussed above with respect to the tactile warning pad 18, unless otherwise expressly described herein. In FIG. 7A, the tactile warning pad 18A has visual feedback elements 36A in the form of light rings that surround one or more of the tactile structures 44A (e.g., bumps). In FIG. 7B, the tactile warning pad 18B has visual feedback elements 36B in the form of lights (e.g., LEDs) that are respectively positioned on top of or at least partially embedded within one or more of the corresponding tactile structures 44B (e.g., bumps). In FIG. 7C, the tactile warning pad 18C has visual feedback elements 36C in the form of lights that are on the base tactile warning pad structure, offset from one or more of the tactile structures 44C (e.g., bumps). That is, the visual feedback elements 36C may be located between the various tactile structures 44C. It is to be understood that the placement of the visual feedback elements 36C could be mixed and matched per any the arrangements shown in FIGS. 7A-7C.

The tactile warning pad 18 may include further enhancements in the form of, for example, pad photovoltaics 38 and/or a pad heater 40. The provision of pad photovoltaics 38 can act as an eco-friendly manner of helping to power the tactile warning pad 18 and/or other electrical elements of the crosswalk system 10. Further, the pad photovoltaics 38 can serve as an optical sensor, at least during times of sufficient ambient light. That is, the presence of a pedestrian on the pad photovoltaics may impede or interrupt the generation of an electrical current by the pad photovoltaics 38, and such a change in current may be used as a communications signal regarding the presence of one or more pedestrians on the tactile warning pad 18. Additionally, a pad heater 40 may be present to serve as an aid in melting snow and/or ice from the tactile warning pad 18, reducing the chances for slipping when heading into a crosswalk or boarding a train. Also, the pad heater 40 may prove useful when pad photovoltaics 38 and/or an optical-based proximity sensor 32 are present, as the presence of ice and/or snow on the tactile warning pad 18 may, of course, interfere with the efficiency of the pad photovoltaics 38 and/or the optical-based proximity sensor 32. In some embodiments, the pad heater 40 may include a sensor which limits the activation of the pad heater 40, e.g., to when the temperature drops below a certain point (e.g., 35° F. or 32° F.) or to times when snow and/or ice are present.

Figure 8:
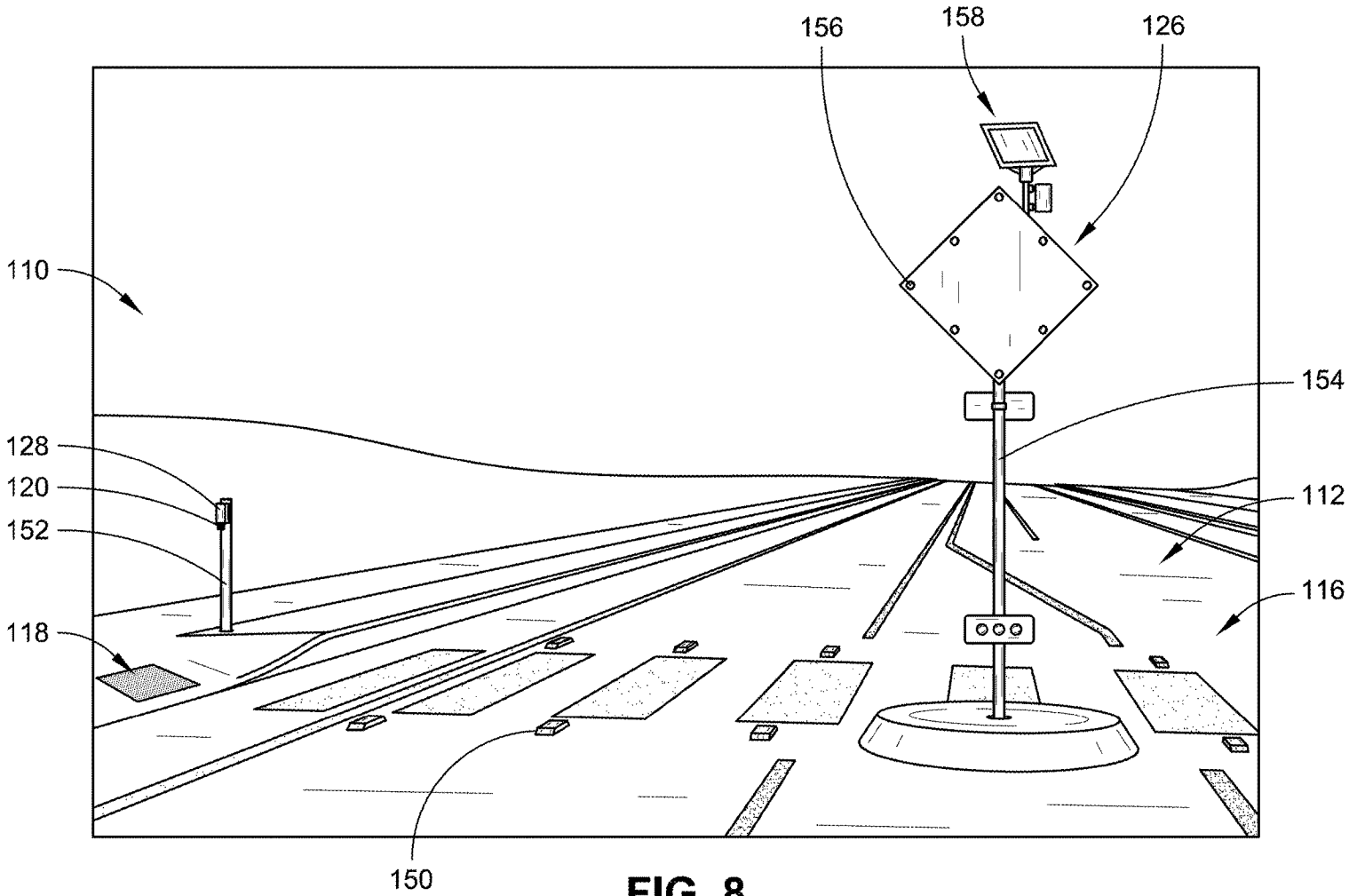
FIG. 8 is a perspective view of another crosswalk employing embedded road lighting and a crosswalk sign provided with blinking lights, in accordance with example embodiments of the present disclosure.

FIG. 8 illustrates another embodiment of a crosswalk system 110. Like numbered parts in the crosswalk system 110 as those associated with the crosswalk system 10 are expected to have the same general features and/or functionality as discussed above with respect to the crosswalk system 10, unless otherwise expressly described herein. The crosswalk system 110 for use in aiding a pedestrian to safely cross a road 112, can include, for example, a marked crossing 116, a tactile warning pad 118, an activation button 120 (e.g., signal call button), a signal-enhanced crosswalk sign 126, a crossing control unit 128, and a series of pavement-embedded signal lights 150. In some embodiments, the crosswalk system 110 can also employ additional elements (such as a crosswalk signal) and still be within the scope of this embodiment. Per the illustrated embodiment, it is seen that the activation button 120 and the crossing control unit 128 are mounted on a support post 152, and the signal-enhanced crosswalk sign 126 is carried by a sign post 154.

The signal-enhanced crosswalk sign 126 can be provided with one or more signage signal lights 156 (e.g., LEDs). Such signage signal lights 156 may, in one example, be configured to blink for a duration set by the crossing control unit 128, upon activation of a crossing sequence via the tactile warning pad 118 and/or the activation button 120. In the illustrated example, the signage signal lights 150 are generally positioned at the perimeter of the signal-enhanced crosswalk sign 126.

The crosswalk system 110 may further include the series of pavement-embedded signal lights 150. Like the signage signal lights 156, the pavement-embedded signal lights 150 may be configured to light up (e.g., solid (non-blinking) or blinking/flashing) during the crossing sequence set by the crossing control unit 128. Further, for example, the rate of blinking may change (e.g., speed up) near the end (e.g., last five (5) seconds) of a crossing sequence to alert a pedestrian and/or a motorist that the crossing sequence is nearing an end. The pavement-embedded signal lights 150 may prove useful in alerting both the pedestrian(s) and any motorist of the crossing sequence, whereas the signal-enhanced crosswalk sign 126 is primarily useful for any motorists (i.e., such a sign is aligned to be seen mainly by any oncoming motorist, more so than by a pedestrian). It is to be understood that the signal-enhanced crosswalk sign 126 and/or the pavement-embedded signal lights 150 may be used alone or in combination with one another.

As seen also in FIG. 8, the sign post 154 may carry a solar unit 158 for powering the signal-enhanced crosswalk sign 126 and/or other electrical components of the crosswalk system 110. The provision of a solar unit 158 (which can include, e.g., solar cells, a power converter, and/or a rechargeable battery) can prove beneficial for at least a couple of reasons. The solar unit 158 is eco-friendly, but it also can make the crosswalk system 110 or at least the signal-enhanced sign 126 self-sufficient for power, thereby eliminating the need to provide an electrical grid connection to a location that may not otherwise be readily accessible.

A processor can be included as part of the crossing control unit 28, 128, mobile device 46, and/or the pad communication and control unit 42 to control the components and functions of systems 10, 110 and/or the tactile warning pad 18, 118, as the case may be, described herein using software, firmware, hardware (e.g., fixed logic circuitry), manual processing, or a combination thereof. The terms "controller," "functionality," "service," and "logic" as used herein generally represent software, firmware, hardware, or a combination of software, firmware, or hardware in conjunction with controlling the systems 10 or 110 or the tactile warning pad 18, 118, as the case may be. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

The crossing control unit 28, 128, mobile device 46, and/or the pad communication and control unit 42 can also include a processor, memory, and communications interface. The crossing control unit 28, 128, mobile device 46, and/or the pad communication and control unit 42 can include any number of processors, micro-controllers, or other processing systems, and resident or external memory for storing data and other information accessed or generated by the crossing control unit 28, 128, mobile device 46, and/or the pad communication and control unit 42. The processor can execute one or more software programs that implement techniques described herein. The processor is not limited by the materials from which it is formed or the processing mechanisms employed therein and, as such, can be implemented via semiconductor(s) and/or transistors (e.g., using electronic integrated circuit (IC) components), and so forth.

The memory is an example of tangible, computer-readable storage medium that provides storage functionality to store various data associated with operation of the crossing control unit 28, 128, mobile device 46, and/or the pad communication and control unit 42, such as software programs and/or code segments, or other data to instruct the crossing control unit 28, 128, mobile device 46, and/or the pad communication and control unit 42, and possibly other components of the crosswalk system 10, 110, to perform the functionality described herein. Thus, the memory can store data, such as a program of instructions for operating the system 10, 110 (including its components), and so forth. It should be noted that while a single memory is described, a wide variety of types and combinations of memory (e.g., tangible, non-transitory memory) can be employed. The memory can be integral with the processor, can comprise stand-alone memory, or can be a combination of both.

The communications interface is configured to communicate with components of the system 10, 110. For example, the communications interface can be configured to transmit data for storage in the system 10, 110, retrieve data from storage in the system 10, 110, and so forth. The communications interface is also communicatively coupled with the processor to facilitate data transfer between components of the system 10, 110 and the processor. It should be noted that while the communications interface is described as a component of the crossing control unit 28, 128, mobile device 46, and/or the pad communication and control unit 42, one or more components of the communications interface can be implemented as external components communicatively coupled to such units via a wired and/or wireless connection. The system 10, 110 can also comprise and/or connect (wired or wireless) to one or more input/output (I/O) devices (e.g., via the communications interface), such as the tactile warning pad 18, 118, an activation button 20, 120, a client device, a display, a mouse, a touchpad, a keyboard, and so on.

The communications interface and/or the processor can be configured to communicate with a variety of different networks, including, but not necessarily limited to: a wide-area cellular telephone network, such as a 3G cellular network, a 4G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface can be configured to communicate with a single network or multiple networks across different access points.

Generally, any of the functions described herein can be implemented using hardware (e.g., fixed logic circuitry such as integrated circuits), software, firmware, manual processing, or a combination thereof. Thus, the blocks discussed in the above disclosure generally represent hardware (e.g., fixed logic circuitry such as integrated circuits), software, firmware, or a combination thereof. In the instance of a hardware configuration, the various blocks discussed in the above disclosure may be implemented as integrated circuits along with other functionality. Such integrated circuits may include all of the functions of a block, system, or circuit, or a portion of the functions of the block, system, or circuit. Further, elements of the blocks, systems, or circuits may be implemented across multiple integrated circuits. Such integrated circuits may comprise various integrated circuits, including, but not necessarily limited to: a monolithic integrated circuit, a flip chip integrated circuit, a multichip module integrated circuit, and/or a mixed signal integrated circuit. In the instance of a software implementation, the various blocks discussed in the above disclosure represent executable instructions (e.g., program code) that perform specified tasks when executed on a processor. These executable instructions can be stored in one or more tangible computer readable media. In some such instances, the entire system, block, or circuit may be implemented using its software or firmware equivalent. In other instances, one part of a system, block, or circuit may be implemented in software or firmware, while other parts are implemented in hardware.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A tactile warning pad operable in conjunction with a crossing signal, the tactile warning pad comprising:

a base tactile pad having a plurality of tactile structures comprising bumps on a surface of the base tactile pad;

a pad communication and control unit at least partially housed within or coupled to the base tactile pad, the pad communication and control unit being communicatively coupled to a crossing control unit for the crossing signal; and a warning output device communicatively coupled to the pad communication and control unit and at least partially housed within or coupled to the base tactile pad, the warning output device configured to receive a warning control signal from the crossing control unit via the pad communication and control unit, the warning control signal being based on a status of the crossing signal, the warning output device further configured to generate an output warning based on the warning control signal, wherein the warning output device comprises a plurality of visual feedback elements coupled to or at least partially embedded in the base tactile pad.

2. The tactile warning pad of claim 1, wherein the plurality of visual feedback elements comprise a plurality of light rings disposed about respective tactile structures of the plurality of tactile structures.

3. The tactile warning pad of claim 1, wherein the plurality of visual feedback elements comprise a plurality of light sources embedded within respective tactile structures of the plurality of tactile structures.

4. The tactile warning pad of claim 1, wherein the plurality of visual feedback elements comprise a plurality of light sources disposed between respective tactile structures of the plurality of tactile structures.

5. The tactile warning pad of claim 1, wherein the warning output device further comprises at least one haptic feedback element at least partially housed within or coupled to the base tactile pad, the at least one haptic feedback element configured to vibrate the base tactile pad to generate the output warning based on the warning control signal.

6. The tactile warning pad of claim 1, wherein the warning output device further comprises at least one audible feedback element at least partially housed within or coupled to the base tactile pad.

7. The tactile warning pad of claim 1, further comprising at least one pad photovoltaic array at least partially housed within or coupled to the base tactile pad, the at least one pad photovoltaic array configured to generate power for at least one of the pad communication and control unit or the warning output device.

8. The tactile warning pad of claim 1, further comprising at least one pad heater at least partially housed within or coupled to the base tactile pad, the at least one pad heater configured to heat the base tactile pad when a temperature below a threshold temperature is detected.

9. The tactile warning pad of claim 1, further comprising a proximity sensor at least partially housed within or coupled to the base tactile pad, the proximity sensor configured to detect a pedestrian approaching or standing on the base tactile pad, wherein the pad communication and control unit is communicatively coupled to the proximity sensor and is configured to generate a control signal for the crossing control unit when the proximity sensor detects the pedestrian approaching or standing on the base tactile pad.

10. A crosswalk system comprising:

a crossing control unit;

a crossing signal configured to operate based upon one or more signals received from the crossing control unit, the crossing signal configured to alert one or more of a motorist and a pedestrian; and a tactile warning pad mounted on a sidewalk and being operable in conjunction with the crossing control unit, the tactile warning pad comprising:

a base tactile pad having a plurality of tactile structures comprising bumps on a surface of the base tactile pad;

a pad communication and control unit and at least partially housed within or coupled to the base tactile pad, the pad communication and control unit being communicatively coupled with the crossing control unit; and a warning output device communicatively coupled with the pad communication and control unit and at least partially housed within or coupled to the base tactile pad, the warning output device configured to receive a warning control signal from the crossing control unit via the pad communication and control unit, the warning control signal being based on a status of the crossing signal, the warning output device further configured to generate an output warning based on the warning control signal, wherein the warning output device comprises a plurality of visual feedback elements coupled to or at least partially embedded in the base tactile pad.

11. The crosswalk system of claim 10, wherein the plurality of visual feedback elements comprise a plurality of light rings disposed about respective tactile structures of the plurality of tactile structures.

12. The crosswalk system of claim 10, wherein the plurality of visual feedback elements comprise a plurality of light sources embedded within respective tactile structures of the plurality of tactile structures.

13. The crosswalk system of claim 10, wherein the plurality of visual feedback elements comprise a plurality of light sources disposed between respective tactile structures of the plurality of tactile structures.

14. The crosswalk system of claim 10, wherein the warning output device further comprises at least one haptic feedback element at least partially housed within or coupled to the base tactile pad, the at least one haptic feedback element configured to vibrate the base tactile pad to generate the output warning based on the warning control signal.

15. The crosswalk system of claim 10, wherein the warning output device further comprises at least one audible feedback element at least partially housed within or coupled to the base tactile pad.

16. The crosswalk system of claim 10, further comprising at least one pad photovoltaic array at least partially housed within or coupled to the base tactile pad, the at least one pad photovoltaic array configured to generate power for at least one of the pad communication and control unit or the warning output device.

17. The crosswalk system of claim 10, wherein the tactile warning pad further comprises at least one pad heater at least partially housed within or coupled to the base tactile pad, the at least one pad heater configured to heat the base tactile pad when a temperature below a threshold temperature is detected.

* * * * *